US006385894B1

(12) United States Patent
Podvin

(10) Patent No.: US 6,385,894 B1
(45) Date of Patent: May 14, 2002

(54) AIMING DEVICE

(75) Inventor: Mark T. Podvin, Andover, MN (US)

(73) Assignee: Ballisti-Guard, Inc., Cirlce Pines, MN (US)

( * ) Notice: Subject to any disclaimer, the term of this patent is extended or adjusted under 35 U.S.C. 154(b) by 0 days.

(21) Appl. No.: 09/710,519

(22) Filed: Nov. 9, 2000

(51) Int. Cl.[7] ..... F41G 1/34
(52) U.S. Cl. ..... 42/146; 42/117
(58) Field of Search ..... 42/146, 113, 114, 42/115, 117

(56) References Cited

U.S. PATENT DOCUMENTS 4,164,081 A * 8/1979 Berke ..... 434/22
4,232,456 A * 11/1980 Harmon et al. ..... 348/121
4,657,511 A * 4/1987 Allard et al. ..... 434/20
4,680,012 A * 7/1987 Morley et al. ..... 434/20
4,786,966 A * 11/1988 Hanson et al. ..... 224/181
4,835,621 A * 5/1989 Black ..... 352/95
4,955,812 A * 9/1990 Hill ..... 434/16
5,685,636 A * 11/1997 German ..... 361/232
5,704,155 A * 1/1998 Primeau, IV ..... 362/110
5,834,676 A * 11/1998 Elliott ..... 42/113
5,924,868 A * 7/1999 Rod ..... 348/158
6,000,163 A * 12/1999 Gordon ..... 352/84
6,266,911 B1 * 7/2001 Suzuki ..... 250/201.2

* cited by examiner

*Primary Examiner*—Michael J. Carone
*Assistant Examiner*—Denise J Buckley
(74) *Attorney, Agent, or Firm*—Beck & Tyver, P.L.L.C.

(57) ABSTRACT

The present invention relates to a firearm aiming device and includes a camera mounted on a handgun for relaying images to a monitor carried on the torso of the user.

1 Claim, 3 Drawing Sheets

AIMING DEVICE

FIELD OF THE INVENTION

The present invention relates generally to handguns and more particularly to a device that increases the safety of the user or operator.

BACKGROUND OF THE INVENTION

Gun mounted cameras are know from U.S. Pat. No. 5,711,104 to Schmitz among others. System like that taught by Schmitz require that the user or operator aim the weapon solely with the aid of the camera.

SUMMARY

In contrast to the prior art the present invention discloses a camera adapted for mounting on a handgun. The camera may be used to sight the weapon or the conventional open sight associated with the weapon may be used. The change over between sighting techniques is done without any change to the hardware configuration of the weapon.

A light is also fixed to the gun and this may be used to inspect the field of view. In operation the light is powered by a connection to a user pack or unit that houses batteries and a camera display system. The weight and volume of the user pack is low and the console unit maybe mounted on the torso or arm of the user.

An optional transmitter is provided to transmit the camera image to a remote site. An optional GPS (Global Positioning System) may be also be included in the system along with a motion detector.

In use the user may use the weapon and its associated camera and light to investigate a crime scene while the user is hidden from view and therefore protected. Only the user's hand may be exposed. In the event that the user is injured, the motion detector may set off an alarm and send the position of the user to the remote site. In the context of a police raid the ability to track the position, status and the observations of each officer from a remote location can materially aid the organization and execution of the raid.

BRIEF DESCRIPTION OF THE DRAWINGS

Throughout the several views of the drawing like reference numerals indicate identical structures wherein.

DETAILED DESCRIPTION

Figure 1:
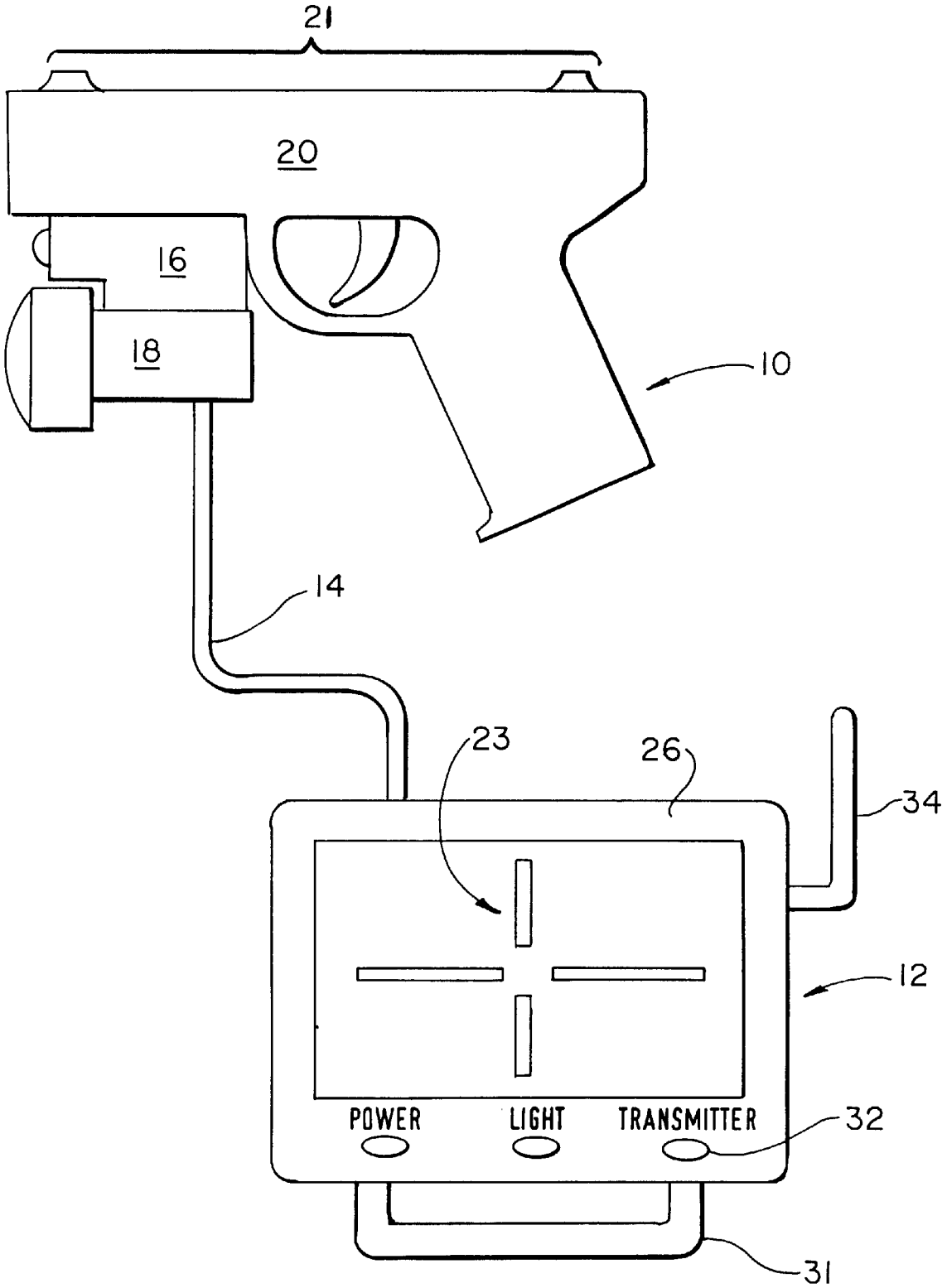
FIG. 1 is a schematic representation of the system.

FIG. 1 shows a handgun assembly 10 and the user control unit 12. The user control pack is coupled to the handgun assembly through a short cable 14. The relative sizes of the handgun and user control unit allow the user pack or unit to be mounted on the body of the user with a strap or the like. The small size of the control unit will allow it to be mounted on the forearm or torso of the user. In these locations it is readily available for use without hampering the ability of the user to move about. A handle 31 is also provided to manipulate the unit without attaching the unit to the torso or arm.

The handgun assembly 10 includes a solid state camera (CCD device) 16 and a tactical light 18. In general these items may be mounted in front of the trigger guard on a handgun 20 which places them "out of the way" so that there is a minimal impact on the normal handling character of the handgun 20. The cable 14 may be supplied in various lengths to allow the user to minimize the total length of cable in use. A set of cross hairs 23 can be printed or taped on the display 26 to permit aiming of the gun while using the camera 16. It is important that the use of the camera 16 does not interfere with the use of the normal open sights 21. It is preferred to mount the camera under the barrel in front of the trigger guard. It is also preferred to mount the light under the camera.

Figure 2:
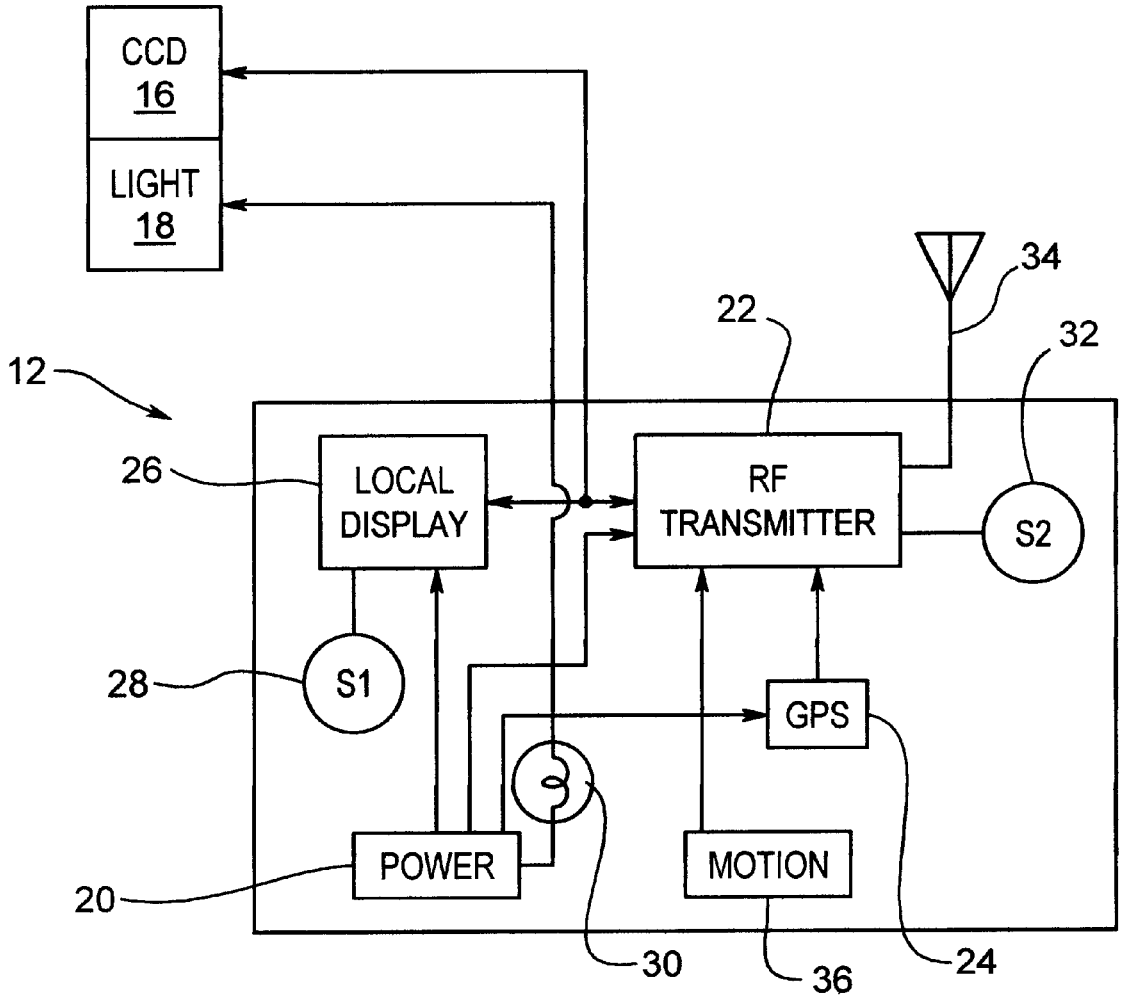
FIG. 2 is a schematic representation of the parts of the system.

FIG. 2 shows the internal architecture of the user control unit 12. The power supply 20 is preferable a battery pack with rechargeable and replaceable cells preferred. The power source supplies power to the transmitter 22 the GPS receiver 24 and the camera display 26. A switch 28 is available to the user to turn off the display. In a similar fashion a switch 30 can be used to turn off the light 18 and a switch 32 can be used to turn off the transmitter 22. In use the motion detector will be activated whenever the user is in motion. A simple mercury switch can be used to detect gross motion. If the user is inactive for a time the transmitter will be turned on and the postion from the GPS receiver will be transmitted to a remote site. If a policeman is "down" then aid can be sent immediately. This automatic feature is optional.

In a typical scenario the policeman user will enter a building and use the gun with its associated light and camera to view the scene without exposing the policeman to a line of fire. For example the gun can be held around a corner without the body of the office being visible. In this mode the user will observe the scene on the control unit display screen 26 mounted to his body.

Figure 3:
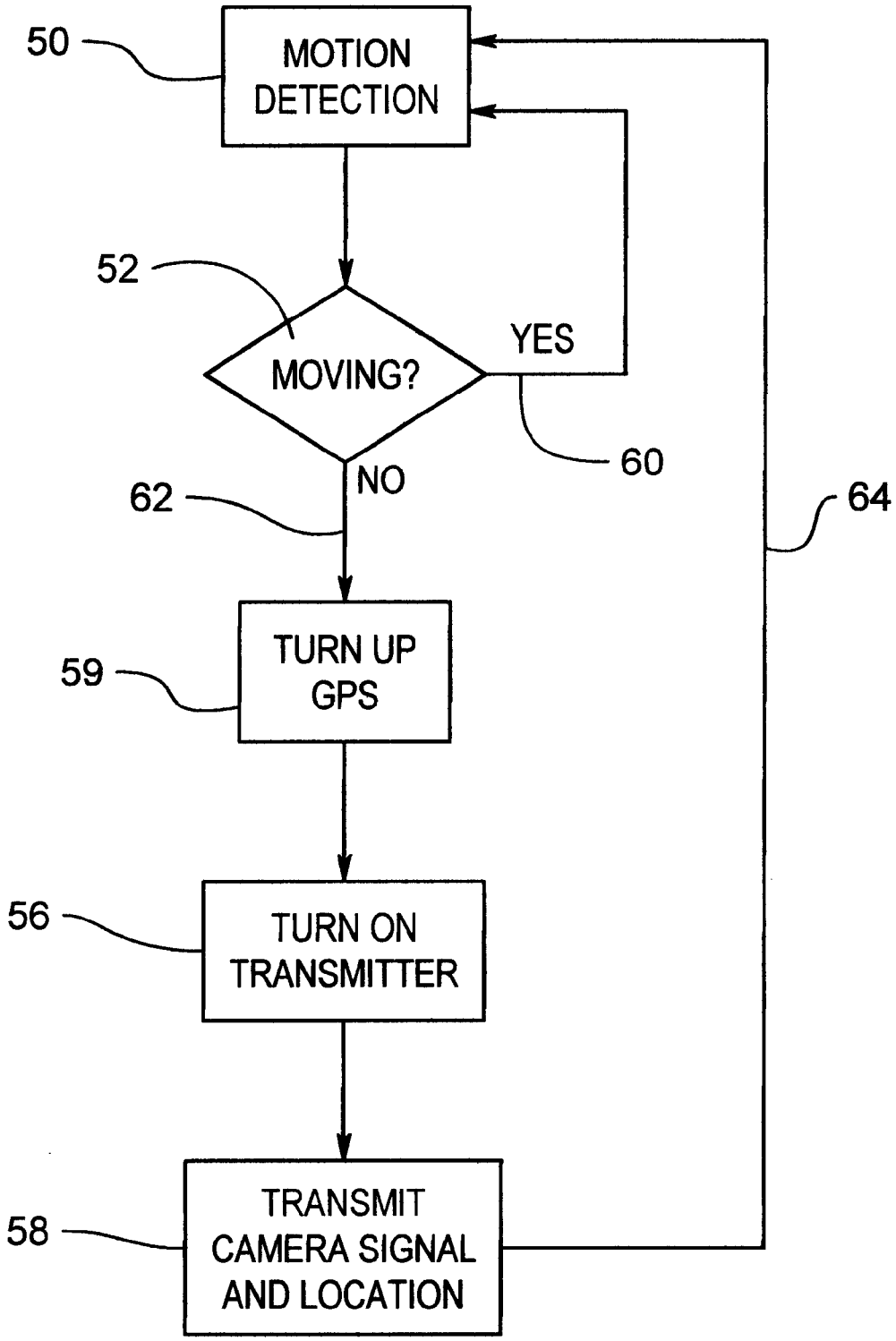
FIG. 3 is flow chart showing an automatic feature of the system.

FIG. 3 shows a flow chart for implementing a process that can optionally be performed by the device. In process 50 the motion detector generates a signal indicative of motion. If motion is detected the process return and starts again as indicated by decision 60. If the officer is "down" and no motion is detected the GPS receiver is turned on in process 54 by decision 62. While the GPS receiver is acquiring position information the transmitter is turned on process 56 and the next the GPS based location is sent out through the transmitter 22 and antenna 34 (seen in FIG. 2).

What is claimed is:

1. An aiming device comprising:

a solid state camera coupled to a handgun;

a tactical light attached to a handgun;

a remote user control box connected to said solid sate camera and said tactical light;

said user control box having a display screen for viewing the scene observed by said solid state camera;

a plurality of switches for controlling said tactical light and said display;

said user control box including a battery for powering said camera and for powering said light.

* * * * *